US006845522B2

(12) United States Patent
Béland

(10) Patent No.: US 6,845,522 B2
(45) Date of Patent: Jan. 25, 2005

(54) SHOULDER PADS WITH INTEGRAL ARM PROTECTORS

(75) Inventor: Jean-François Béland, St-Laurent (CA)

(73) Assignee: Bauer Nike Hockey Inc., St-Jerome (CA)

( * ) Notice: Subject to any disclaimer, the term of this patent is extended or adjusted under 35 U.S.C. 154(b) by 326 days.

(21) Appl. No.: 10/011,721

(22) Filed: Dec. 11, 2001

(65) Prior Publication Data

US 2002/0069454 A1 Jun. 13, 2002

(30) Foreign Application Priority Data

Dec. 12, 2000 (CA) ..... 2328023

(51) Int. Cl.[7] ..... A41D 13/00
(52) U.S. Cl. ..... 2/461; 2/16
(58) Field of Search ..... 2/459, 461, 462, 2/463, 467, 44, 45, 268, 92, 455, 102, 16, 908

(56) References Cited

U.S. PATENT DOCUMENTS

| | | | | |
|---|---|---|---|---|
| 653,544 | A | | 7/1900 | Burn et al. |
| 1,489,048 | A | * | 4/1924 | Whitley ..... 2/462 |
| 1,862,442 | A | | 6/1932 | Till |
| 1,970,130 | A | | 8/1934 | Dickenson |
| 2,545,039 | A | | 3/1951 | Mitchel |
| 3,088,115 | A | | 5/1963 | Groot |
| 3,166,760 | A | | 1/1965 | Rasmussen |
| 3,431,560 | A | | 3/1969 | Austin |
| 3,509,579 | A | | 5/1970 | Morgan |
| 3,528,106 | A | | 9/1970 | Austin |
| 3,739,397 | A | | 6/1973 | Truelove |
| 3,867,726 | A | | 2/1975 | Owl et al. |
| 4,295,227 | A | * | 10/1981 | Mitchell ..... 2/462 |
| 4,320,537 | A | | 3/1982 | Mitchell |
| 4,501,023 | A | | 2/1985 | Bilberry |
| 4,516,273 | A | | 5/1985 | Gregory et al. |
| 4,590,622 | A | | 5/1986 | Wolfe et al. |
| 4,610,035 | A | | 9/1986 | Mattila |
| 4,654,893 | A | | 4/1987 | Meyers et al. |
| 4,675,912 | A | | 6/1987 | Kirkland |
| 4,697,285 | A | | 10/1987 | Sylvester |
| 4,698,845 | A | | 10/1987 | Cosby |
| 4,821,339 | A | | 4/1989 | Fair |
| 4,982,447 | A | | 1/1991 | Henson |
| 4,996,720 | A | | 3/1991 | Fair |
| 5,007,108 | A | | 4/1991 | Laberge et al. |
| 5,065,457 | A | | 11/1991 | Henson |
| 5,107,542 | A | | 4/1992 | Zide et al. |
| 5,159,715 | A | | 11/1992 | Jurga et al. |
| 5,173,964 | A | | 12/1992 | Ball et al. |
| 5,204,993 | A | | 4/1993 | Siemens |
| 5,390,368 | A | | 2/1995 | Chang |
| 5,398,339 | A | | 3/1995 | Wagner |
| 5,623,728 | A | | 4/1997 | Wagner |
| 5,987,654 | A | | 11/1999 | Chartrand |
| 6,247,188 | B1 | | 6/2001 | Beland |

* cited by examiner

*Primary Examiner*—Tejash Patel

(57) ABSTRACT

The invention provides a protective upper body assembly comprising shoulder pads, a pair of arm protectors, and suspending means. The shoulder pads include a frontal padding element linked to a dorsal padding element by a pair of shoulder arches. Two rigid shells are connected to the shoulder arches and overlie the extremities of the shoulders. With respect to the arm protectors, the latter are capable of being integrally connected to the shoulder pads and each comprises an upper arm protector and a lower arm protector. An elbow shell bridges the lower arm protector and the upper arm protector.

23 Claims, 8 Drawing Sheets

SHOULDER PADS WITH INTEGRAL ARM PROTECTORS

FIELD OF THE INVENTION

The present invention relates to protective equipment for hockey and other such sporting activities. More specifically, the invention relates to a protective upper body assembly.

BACKGROUND OF THE INVENTION

In recent years, security has become an issue of ever-increasing importance in professional and amateur sports. Sports such as hockey are rapidly evolving and becoming more physically demanding, since players are generally bigger and stronger than they ever were. Moreover, contemporary players are also quicker due, in part, to improvements in skate technology. Consequently, protective equipment such as shoulder pads and elbow pads must also evolve to better suit the needs of today's players.

Conventional wisdom has to date dictated that elbow pads and shoulder pads are two distinctive protective items that function independently when worn. Thus, the shoulder pads, which typically feature upper arm protectors, provide protection to the shoulder and upper arm regions of the player while the elbow pads protect the sensitive area of the arm where the cubitus bone is vulnerable at the elbow point. Moreover, traditional elbow pads also protect the upper forearm and the lower biceps areas; the latter being immediately adjacent the elbow joint.

A deficiency typically associated with the above-mentioned protective equipment is the fact that the elbow pad, when in use, has a tendency to slide down the arm of the wearer. Thus, this results in a situation that is cumbersome to the player and which might also distract the latter. Furthermore, the resulting situation also impedes the level of protection since the elbow pad is no longer in its ideal position and portions of the arm are left exposed to injuries. A method frequently used to overcome the above-mentioned deficiency consists in wrapping tape around the elbow pad and thereby securing it against motion. However, this solution often affects the overall comfort of the wearer since an adequate level of tightness is relatively hard to attain. Moreover, it is especially cumbersome to remove after use.

Another deficiency that is common when using traditional elbow pads and shoulder pads can be attributed to the growth of young players' limbs. More specifically, the gap that exists between the elbow pad and the upper arm protector of the shoulder pad tends to widen with age if no replacement equipment is obtained. Moreover, this problem is compounded by the fact that new equipment tends to be fairly costly and thus, young players have a habit of trying to keep their equipment as long as possible. This results in an increasing area of the upper arm that is not protected and is therefore subject to injury.

There is therefore a need in the sports industry for shoulder and elbow pads that can offer an enhanced level of protection as required by contemporary athletes and that can also be adjusted to better accommodate differently sized players and their equipment preferences.

SUMMARY OF THE INVENTION

It is an object of the present invention to provide a protective upper body assembly having an enhanced level of protection which overcomes some of the disadvantages of the prior art.

In accordance with a first broad aspect, the invention provides a protective upper body assembly comprising shoulder pads, a pair of arm protectors, and suspending means. More specifically, the shoulder pads include a frontal padding element linked to a dorsal padding element by a pair of shoulder arches. Two rigid shells are connected to the shoulder arches and overlie the extremities of the shoulders. With respect to the arm protectors, the latter are capable of being integrally connected to the shoulder pads and each comprises an upper arm protector and a lower arm protector. An elbow shell bridges the lower arm protector and the upper arm protector.

Preferably, the protective upper body assembly's suspending means comprise straps and rings for adjusting the distance between the arm protectors and the shoulder pads. More specifically, the straps, which are integrally connected to the arm protectors, feature hooks and loops fasteners that are adapted to couple the arm protectors with the shoulder pads via the rings, the latter being fixedly attached to the shoulder arches of the shoulder pads.

Advantageously, the frontal padding element of the protective upper body assembly comprises a chest padding element, a sternum padding element, a pair of side padding elements, and an abdominal padding element. More specifically, the sternum padding element is located in the center of the chest padding element while the abdominal padding element, positioned in the center of the pair of side padding elements, is below the chest padding element and the sternum padding element.

An advantage of the protective upper body assembly is that the arm protectors cover the entire biceps area of the wearer. As a consequence, the latter is less subject to injury. Moreover, the position of the arm protectors relative to that of the shoulder pads can be varied via the suspending means. Thus, the protective upper body assembly is capable of being adapted to satisfy the needs and requirements of individual players.

Under a second broad aspect, the invention provides a protective upper body assembly comprising shoulder pads, left and right arm protectors, and suspending means. More specifically, the shoulder pads include a frontal padding element coupled to a dorsal padding element by means of shoulder arches. Each arm protector, which is retained to the shoulder pads by means of suspending means, comprises an upper arm protector, a lower arm protector, and an elbow shell.

In a specific example of implementation of the invention, the suspending means, which are adapted to vary the distance between the arm protectors and the shoulder pads, comprise straps and rings as well as hooks and loops fasteners. Moreover, frontal padding element includes, more precisely, a pair of chest padding elements, a sternum padding element, a pair of side padding elements, and an abdominal padding element.

Under another broad aspect, the invention provides a protective upper body assembly comprising shoulder pads as well as left and right arm protectors. Each of the latter includes an upper arm protector and a lower arm protector. An elbow shell bridges the upper arm protector and the lower arm protector.

In yet another broad aspect, the invention provides a protective upper body assembly comprising shoulder pads, left and right upper arm protectors, and left and right elbow pads. A first set of fasteners is included to adjustably connect each upper arm protector to the shoulder pads. A second set of fasteners is also included to adjustably connect each elbow pad to its corresponding upper arm protector.

In a specific example of implementation of the invention, the first and second set of fasteners each comprise a strap including hooks and loops fasteners. Both straps are integrally connected to the upper arm protectors.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

A detailed description of preferred embodiments of the present invention is provided herein below, by way of example only, with reference to the accompanying drawings, in which.

Figure 1:
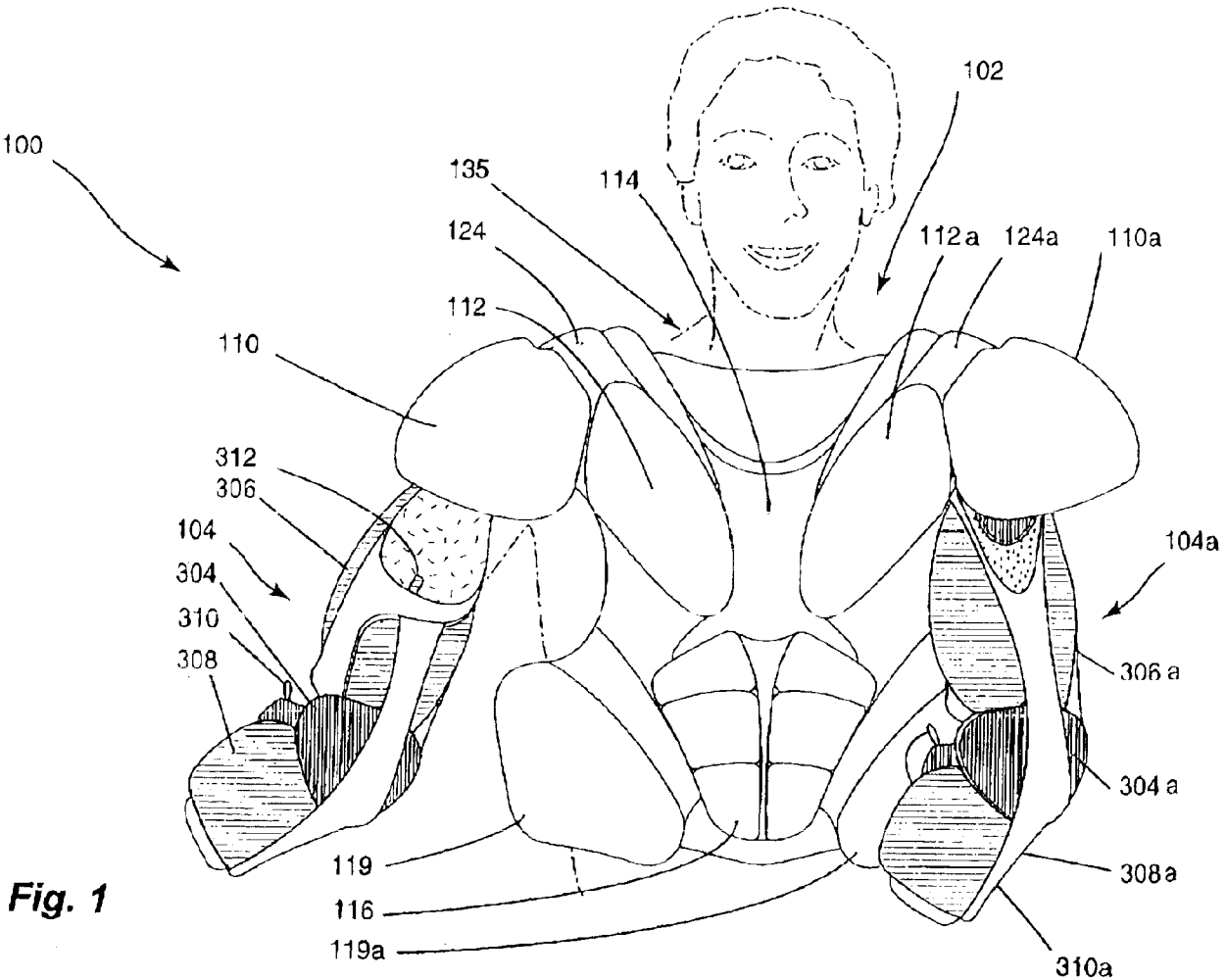
FIG. 1 is a front view of a protective upper body assembly constructed in accordance with the invention.

In the drawings, preferred embodiments of the invention are illustrated by way of examples. It is to be expressly understood that the description and the drawings are only for the purpose of illustration and as an aid to understanding. They are not intended to be a definition of the limits of the invention.

DETAILED DESCRIPTION OF PREFERRED EMBODIMENTS

With reference to FIG. 1, there is shown a first non-limiting example of implementation of the present inventive concept. FIG. 1 illustrates a protective upper body assembly, designated by the reference numeral 100, which is particularly suited for playing the game of ice hockey and other similar sporting activities including roller and street hockey. Protective upper body assembly 100 comprises shoulder pads 102 and integrated arm protectors 104, 104*a* adjustably connected to shoulder pads 102.

Figure 3:
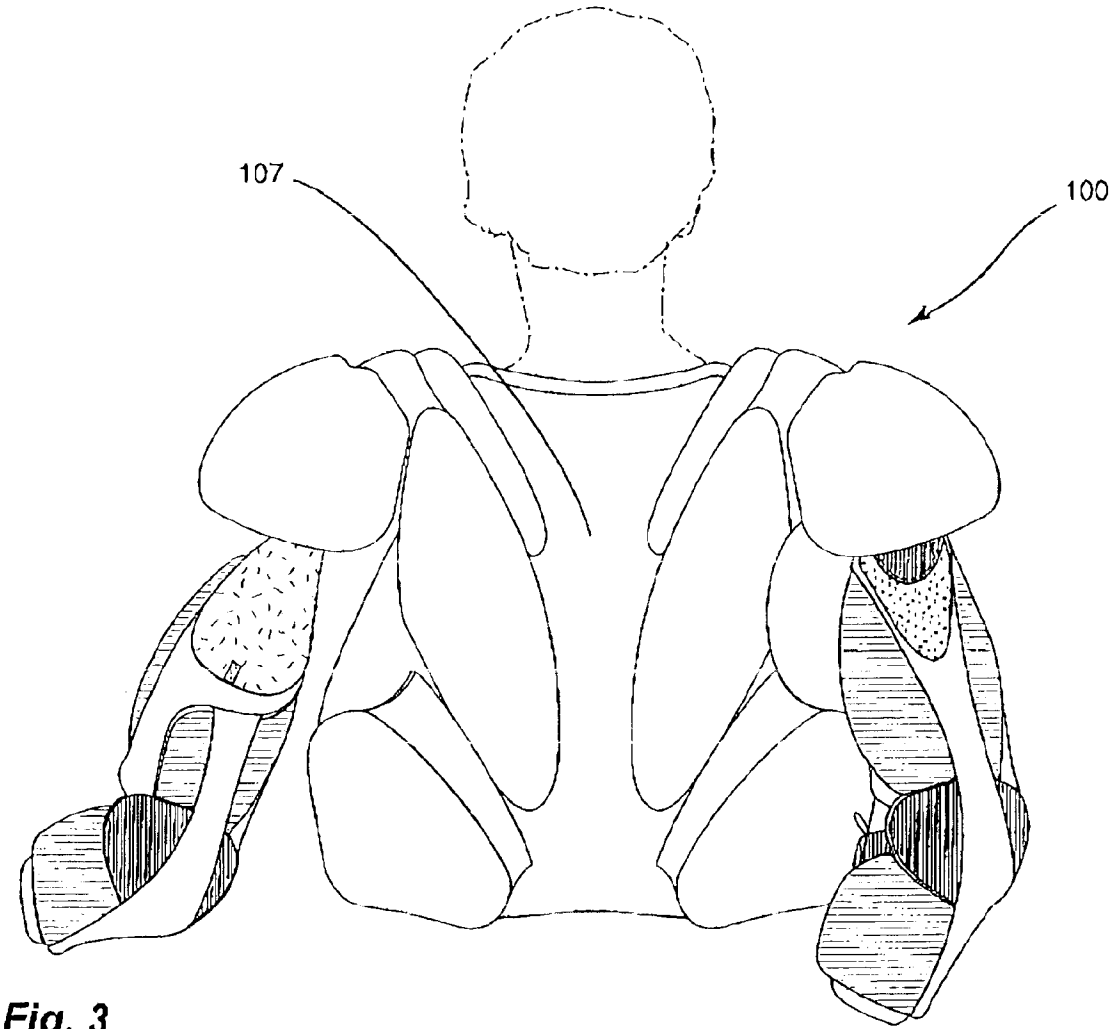
FIG. 3 is a back view of the protective upper body assembly of FIG. 1.

More specifically, shoulder pads 102 comprise a pair of chest padding elements 112, 112*a* as well as a sternum padding element 114; the latter being located in the center of chest padding elements 112, 112*a*. Positioned immediately below the pair of chest padding elements 112, 112*a* and sternum padding element 114, and integrally connected to the above, is an abdominal padding element 116. Side padding elements 119, 119*a* are provided on both sides of abdominal padding element 116. Thus, complete frontal protection is provided by the multiple frontal padding elements, namely: the pair of chest padding elements 112, 112*a*, sternum padding element 114, abdominal padding element 116, and side padding elements 119, 119*a* Shoulder arches 124, 124*a* connect the respective chest padding element 112, 112*a* to a dorsal padding element 107 and, in doing so, define an opening 135 through which the wearer inserts his or her head. Dorsal padding element 107, which is shown in greater detail in FIG. 3, provides protection to the upper and lower back areas of the wearer. The frontal and dorsal padding elements can be made of any suitable material or composition to provide the degree of cushioning and protection that is desired. For example, they can be formed from a relatively thick foam material covered by layers of woven synthetic yarn. More particularly, they can comprise a closed cell foam of ethylene vinyl acetate covered by mesh outer layers of a woven synthetic material such as polyester.

Figure 2:
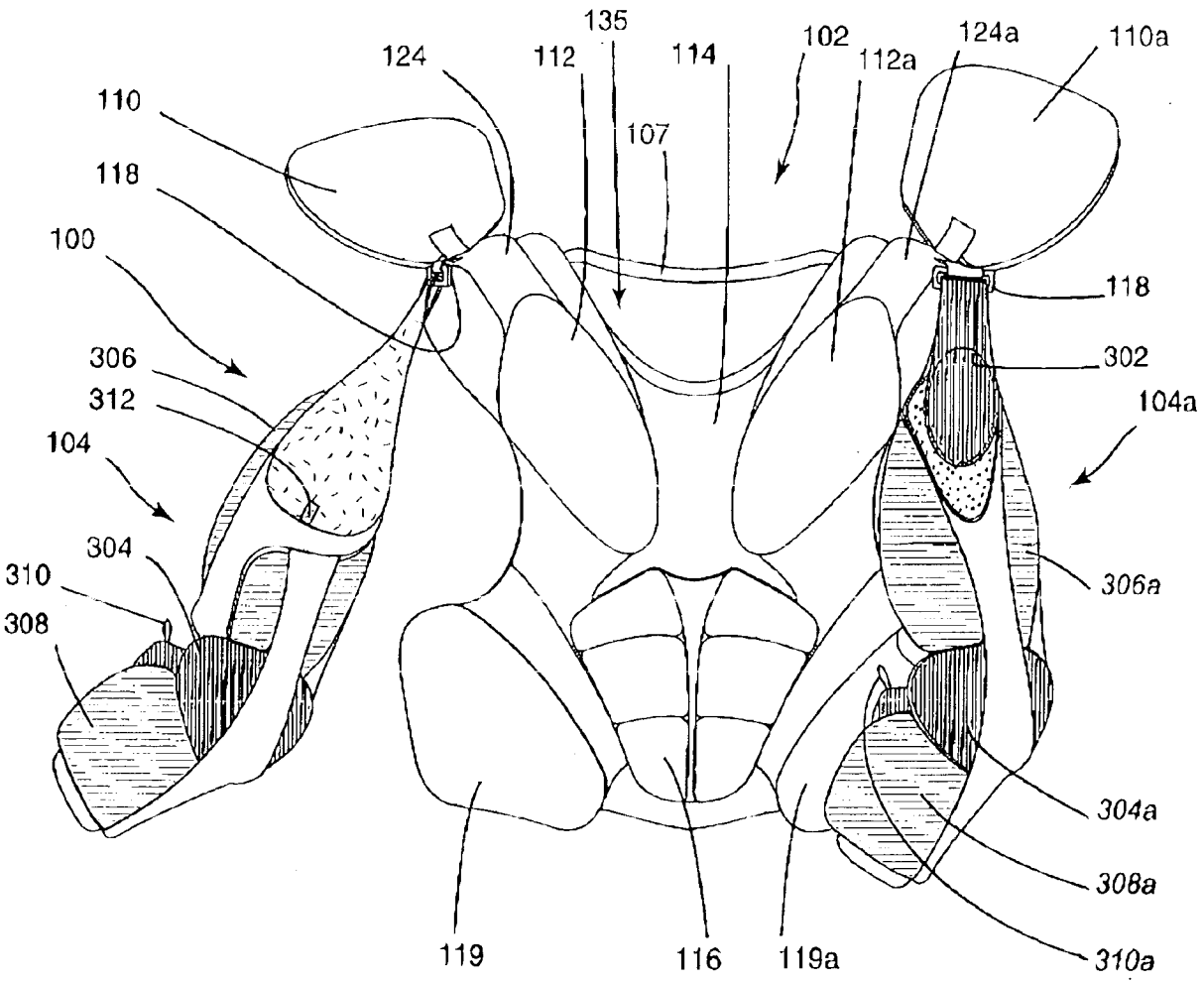
FIG. 2 is a front view of the protective upper body assembly depicted in FIG. 1, with the rigid shells of the shoulder pads shown in elevated position.

The shoulder pads 102 also comprise a pair of molded shoulder caps 110, 110*a* shaped in such a manner as to overlie the right and left shoulder extremities respectively. The molded shoulder caps 110, 110*a*, which are generally made from any rigid material commonly used in the art, are integrally and pivotally connected to the shoulder pads 102 via shoulder arch pads 124, 124*a*. Thus, as shown in FIGS. 1 and 2, the molded shoulder caps 110, 110*a* are capable of being moved up and down about their respective attachment points such as to allow a complete range of motion to the wearer of the protective upper body assembly 100. FIG. 2, more specifically, shows the molded shoulder caps 110, 110*a* at their highest position. Although not shown in the figures, the molded shoulder caps 110, 110*a* could additionally comprise an inner padding element being operative to dampen the intensity of blows received in the general vicinity of the shoulder caps.

Figure 5:
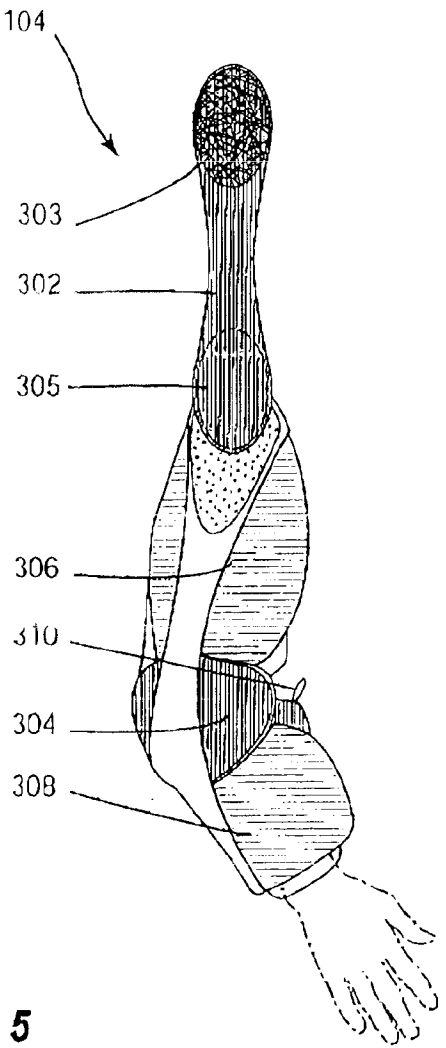
FIG. 5 is a lateral view of the right arm protector depicted in FIG. 4.
Figure 4:
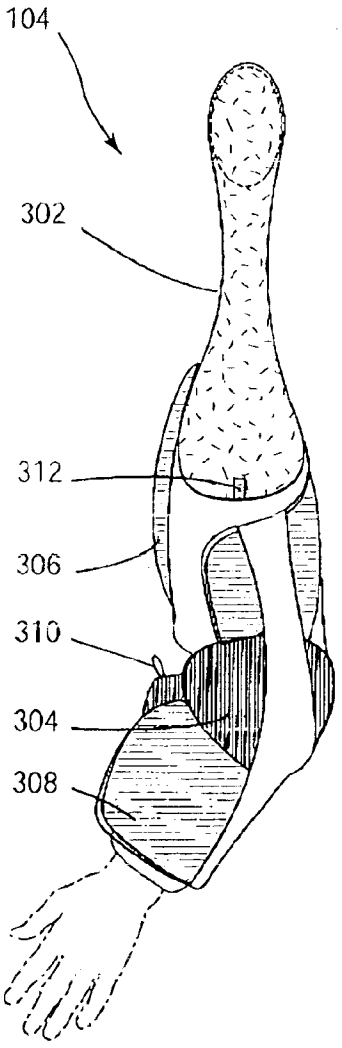
FIG. 4 is a medial view of a right arm protector as used in the protective upper body assembly depicted in FIG. 1, shown unfastened.

FIGS. 4 and 5 depict the right arm protector 104 of FIGS. 1 to 3. It should be understood that the right arm protector 104 is a mirror image of left arm protector 104*a* and is otherwise of identical construction. FIGS. 4 and 5 show right arm protector 104 in its unfastened state prior to its mounting to shoulder pads 102. More specifically, FIG. 4 is a medial view of arm protector 104 while FIG. 5 is a lateral view of the latter. As depicted, arm protector 104 includes a lower arm protector 308 and an upper arm protector 306. A rigid elbow shell 304 covers and protect the elbow point of the wearer and integrally bridges lower arm protector 308 and upper arm protector 306. Thus, lower arm protector 308, which surrounds the lower arm area of the wearer, provides protection to the upper part of the lower arm; the latter region requiring protection since conventional hockey gloves only cover the lower extremity of the lower arm. Moreover, the upper arm protector 306, featuring more padding on its outer side than on its inner side, provides protection to the entire upper arm. Elbow shell 304 surrounds a substantial portion of the elbow area and thereby protects the sensitive area adjacent the elbow point.

Figure 6:
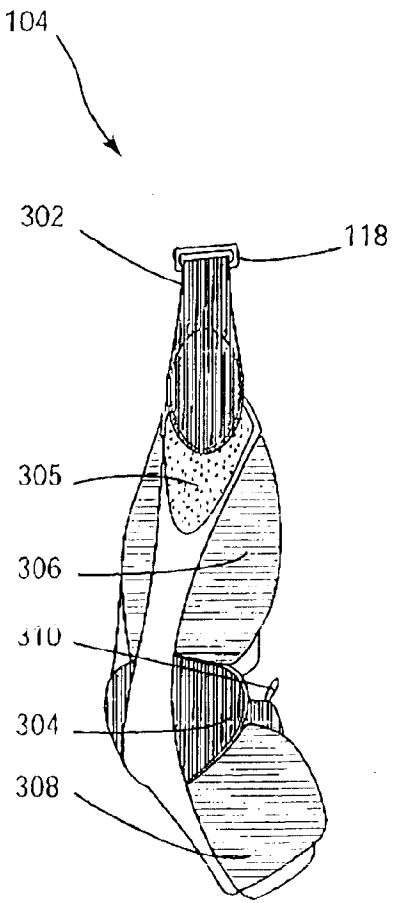
FIG. 6 is a lateral view of the right arm protector depicted in FIG. 5, when in a fastened position.

As shown in FIGS. 4 to 6, arm protector 104 also comprises a strap 302 attached to the inner side of upper arm protector 306. As depicted in FIG. 5, the strap 302 also includes a hooks section 303 at its upper extremity. Moreover, a loops section 305 is located at the upper and outer extremity of upper arm protector 306. Strap 302 extends through a ring 118 that is fixedly attached underneath molded shoulder caps 110, 110*a*; this feature being shown in FIG. 2. More precisely, the rings 118, which can be made of any suitable material such as plastic and the like, are pivotally connected to the extremities of the shoulder arches 124, 124*a* of the shoulder pads 102. It should be noted that the width of the aperture defined by the ring 118 is lesser than that of strap 302 at its extremities since strap 302 is shaped in the form of an hourglass. Thus, strap 302 is retained within the ring 118 in a secure fashion. FIG. 6 shows the arm protector 104 in its fastened state when the hooks section 303 of strap 302 has been coupled with the loops section 305 of upper arm protector 306. In such a position, strap 302 is folded upon itself and the arm protector 104 is thereby attached to shoulder pads 102 and thus defines protective upper body assembly 100. As a consequence, the arm protectors 104, 104*a*, being secured to shoulder pads 102, are thereby prevented from sliding up and down the arm of the wearer when the latter is engaged in physical activity. Although FIGS. 4 to 6 depict that a strap combined with hooks and loops fasteners enable the coupling of arm protector 104 to shoulder pads 102, it should be expressly understood that any other type of fastening means such as buckles and the like can also be used and do not detract from the spirit of the invention.

As depicted in FIG. 4, a pull tab 312 is also attached to the upper arm protector 306 and enables the wearer to position the latter by providing a gripping means so that the wearer can easily pull on the arm protector 104 when the protective upper body assembly 100 is worn. A second pull tab 310, located at the upper end of lower arm protector 308, is provided to enable the wearer to position the lower arm protector 308.

A further advantage of the protective upper body assembly 100 is that the position of the arm protectors 104, 104*a* is adjustable relative to that of the shoulder pads 102. More specifically, the hooks and loops section 303, 305 that respectively characterize the strap 302 and the upper arm protector 306 define a relatively large surface area. This implies that the areas of the hooks 303 and loops section 305 that are coupled together do not have to correspond exactly. Consequently, the position of the arm protectors 104, 104*a* can be adjusted relative to that of the shoulder pads 102. Thus, the protective upper body assembly 100 can be adapted to suit differently shaped players as well as their personal equipment preferences.

When worn, the user slides the protective upper body assembly 100 over his or her head and then inserts his or her right and left arms into arm protectors 104 and 104*a* respectively. The user then grips the pull tabs 312 associated with each arm protector and pulls it to position the upper arm protectors 306 at a desired location. Pull tabs 310, 310*a* are then pulled to position lower arm protectors 308, 308*a* in a snug fashion around the lower arm. Subsequent equipment placement adjustments can be done at any time via each set of pull tabs.

Figure 7:
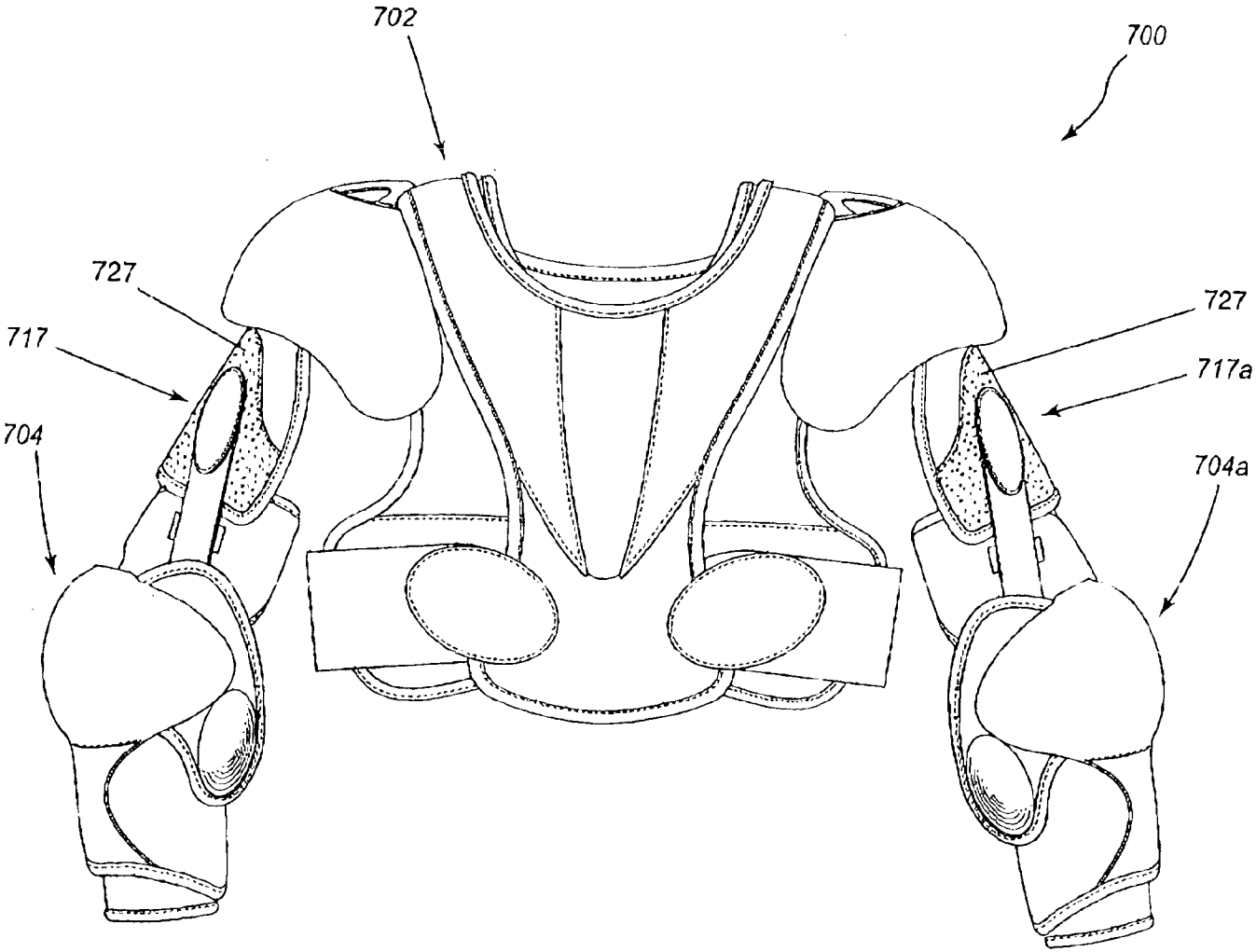
FIG. 7 is a front view of a protective upper body assembly constructed in accordance with a variant.

FIGS. 7 to 15 depict a variant of the invention. More specifically, FIG. 7 illustrates a protective upper body assembly, designated by the reference numeral 700, which comprises shoulder pads 702 and integrated elbow pads 704, 704*a*. In this variant, one of the main differences resides in the fact that the upper arm protectors 717, 717*a* are capable of being adjustably connected to the elbow pads 704, 704*a* as well as to the shoulder pads 702.

Figure 8:
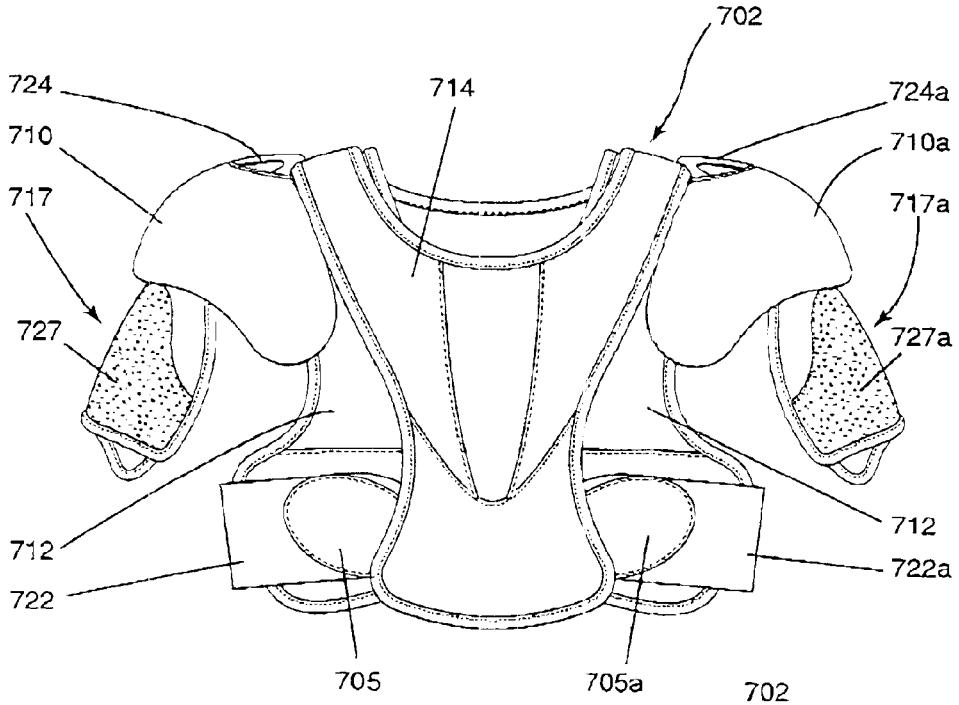
FIG. 8 is a front view of the shoulder pads of the protective upper body assembly depicted in FIG. 7.
Figure 9:
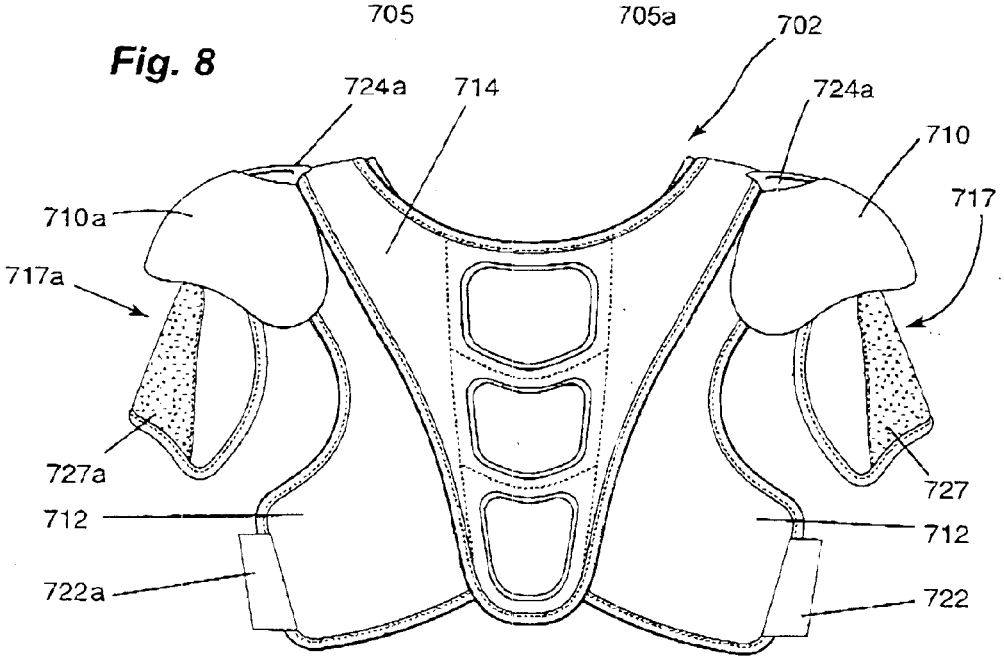
FIG. 9 is a rear view of the shoulder pads depicted in FIG. 8.

As depicted in FIGS. 8 and 9, shoulder pads 702 comprise a primary padding element 714 and a secondary padding element 712 underlying the primary padding element 714. Primary padding element 714 and secondary padding element 712, as corroborated by the figures, provide complete frontal and dorsal protection to the wearer's thoracic region. More specifically, primary padding element 714, in the front, protects the user's sternum, chest, and abdominal regions. From a dorsal perspective, primary padding element 714, which is V-shaped, follows the spinal cord and thereby offers enhanced protection to this very sensitive region of the human body. Secondary padding element 712 provides protection to both side thoracic regions as well as to the lower back. As shown in the figures, a pair of adjustment straps 722, 722*a* are integrally connected, at one extremity, to the lower sides of secondary padding element 712. At their opposite extremities, adjustment straps 722, 722*a* feature hooks type fasteners 705, 705*a* (not shown but underlying the regions designated by the reference numerals) that are adapted to engage the corresponding loops fasteners (not shown) that characterize the lower front portions of secondary padding element 712. Thus, unnecessary relative movement of the front and dorsal components of shoulder pads 702 is minimized when protective upper body assembly 700 is in use. Shoulder arches 724, 724*a* connect the frontal and dorsal portions of secondary padding element 712.

The shoulder pads 702 also comprise a pair of molded shoulder caps 710, 710*a* that shaped in such a manner as to overlie the right and left shoulder extremities respectively. The molded shoulder caps 710, 710*a*, which are generally made from any rigid material commonly used in the art, are integrally and pivotally connected to the shoulder pads 702 via shoulder arch pads 724, 724*a*. As in the previous embodiment, molded shoulder caps 710, 710*a* are capable of being moved up and down about their attachment points such as to allow a complete range of motion to the wearer of the protective upper body assembly 700. Although not shown, the molded shoulder caps 710, 710*a* could additionally comprise an inner padding element being operative to dampen the intensity of blows received in the general vicinity of the shoulder caps. Right and left upper arm protectors 717, 717*a* are capable of being integrally connected (as described with reference to subsequent figures) to the inner portion of each corresponding molded shoulder cap 710, 710*a* and thereby protect the user's upper arm.

Figure 10:
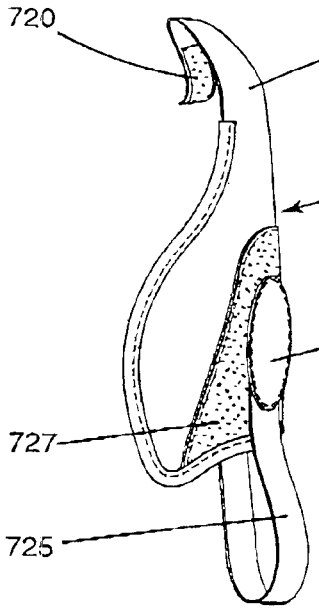
FIG. 10 is a side elevational view of an upper arm protector, the upper arm protector being disassembled from the shoulder pads in order to show the fasteners which enable the coupling of the elbow pads and the shoulder pads.
Figure 11:
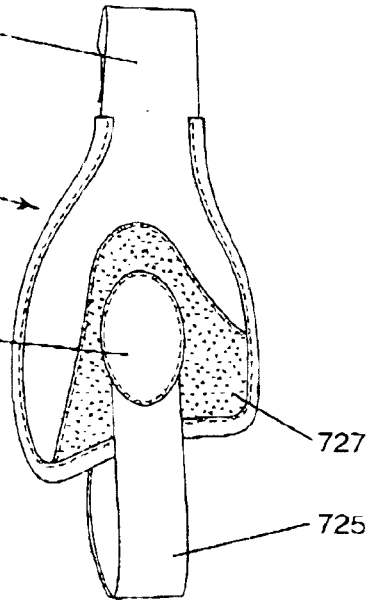
FIG. 11 is a front elevational view of the upper arm protector depicted in FIG. 10.

FIGS. 10 and 11 depict the right upper arm protector 717 of FIGS. 8 and 9. It should be understood that right upper arm protector 717 is a mirror image of left upper arm protector 717*a* and is otherwise of identical construction. FIGS. 10 and 11 show right upper arm protector 717 in its unfastened state prior to its mounting to shoulder pads 702. As depicted, right upper arm protector 717, at its upper extremity, includes a strap 719 including hooks and loops fasteners 720 which enable its coupling to shoulder pads 702. The latter feature will be described in greater detail hereinafter. At its lower extremity, right upper arm protector 717 includes a second strap 725, that is similar to strap 719, and which also includes hooks and loops fasteners 726; the latter being operative to integrally connect upper arm protector 717 with elbow pad 704.

Figure 12:
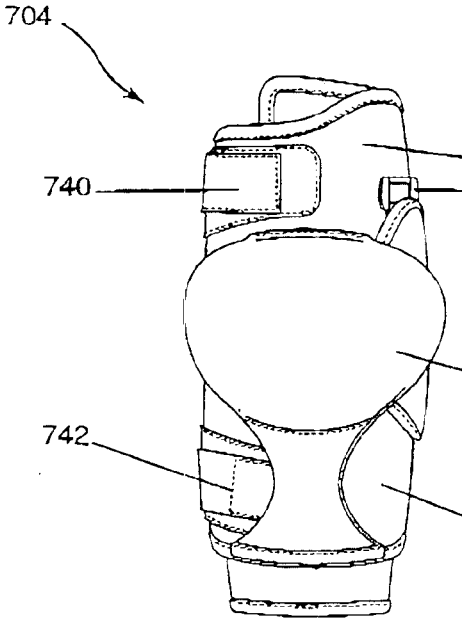
FIG. 12 is a rear elevational view of an elbow pad of the protective upper body assembly depicted in FIG. 7.
Figure 13:
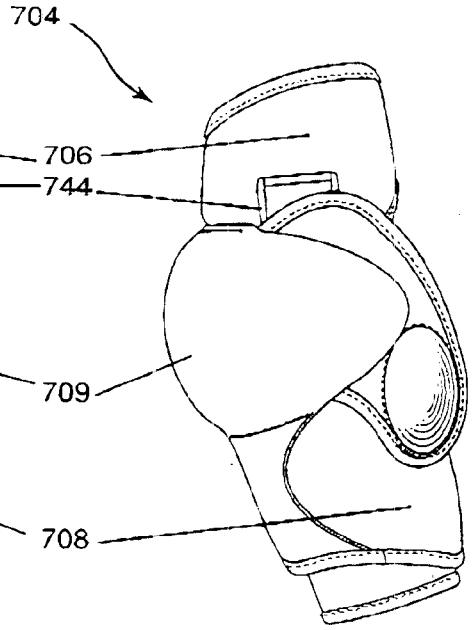
FIG. 13 is a side elevational view of the elbow pad depicted in FIG. 12.
Figures 14, 15:
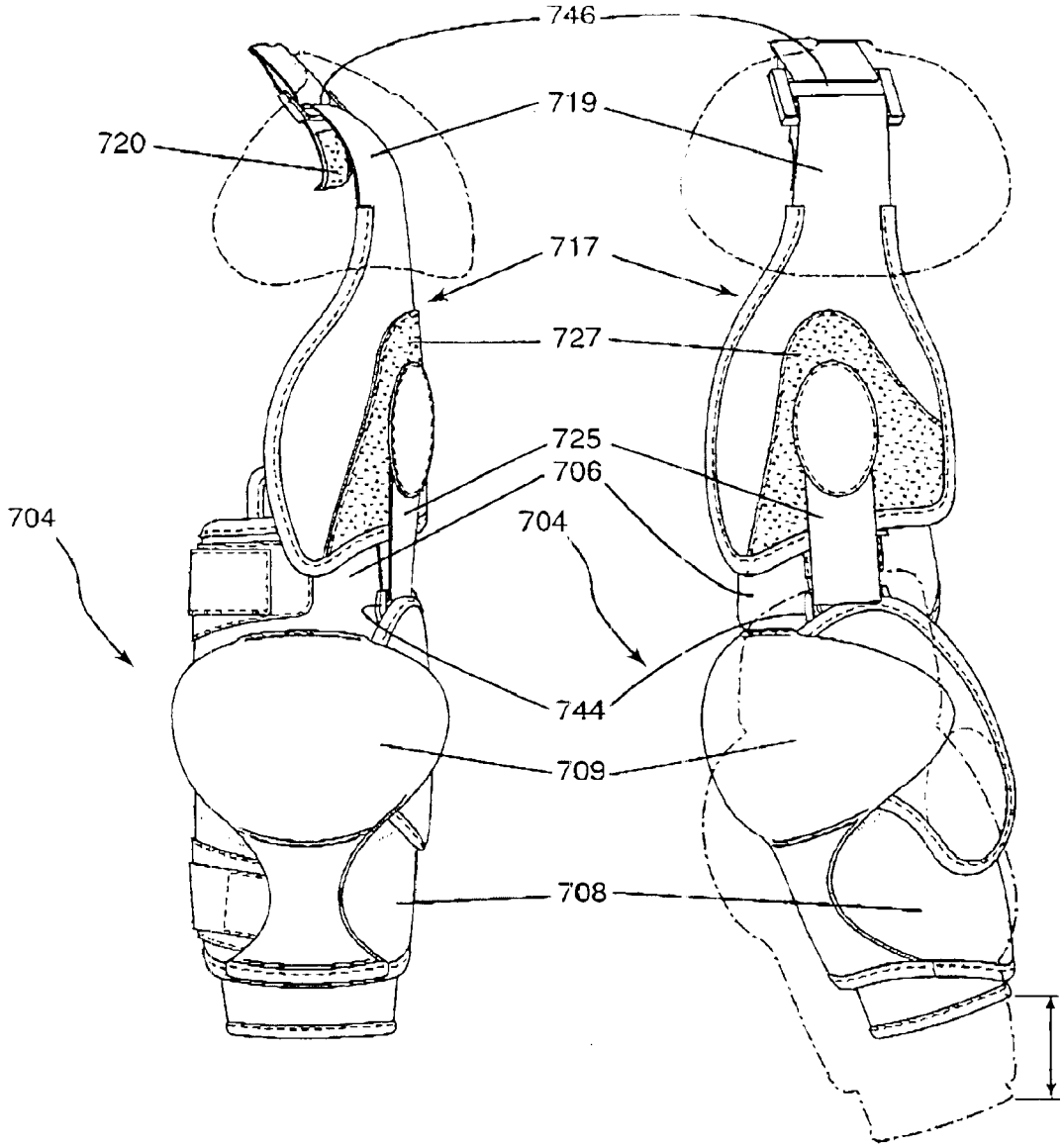
FIG. 14 is a rear view of the elbow pad of FIG. 12 when coupled with the upper arm protector of FIG. 10.
FIG. 15 is a side view of the elbow pad of FIG. 12 when coupled with the upper arm protector of FIG. 10, the stippled lines showing the elbow pad in its most extended position relative to the shoulder pads.

FIGS. 12 and 13 depict an elbow pad 704 that is adapted for use with protective upper body assembly 700. As shown, elbow pad 704 comprises first and second limb encircling bracelets 706, 708. A rigid elbow shell 709, shaped in such a manner as to overlie the elbow point, integrally connects both limb encircling bracelets 706, 708 and thereby defines elbow pad 704. Thus, elbow pad 704 provides protection to the elbow joint, as well as to the upper and lower arm regions of the wearer. Both limb encircling bracelets 706, 708 respectively comprise a strap with hooks and loops fasteners 740, 742 (partially shown) that enable the user to adjust the fit of elbow pad 704 according to his or her preferences. A ring 744 is also fixedly connected to the first limb encircling bracelet 706 immediately above rigid elbow shell 709. As illustrated in FIGS. 14 and 15, ring 744 defines an aperture through which strap 725 is inserted and folded upon itself to connect the corresponding hooks and loops fasteners 726 together. Moreover, straps 719, 719*a*, which are located at the upper extremity of each upper arm protector 717, 717*a* can also be inserted into rings 746 that are fixedly connected to shoulder arches 724, 724*a* underneath the molded shoulder caps 710, 710*a*, and subsequently folded upon themselves to create a connection via hooks and loops fasteners 720. As illustrated in FIG. 7, the coupling of these components results in protective upper body assembly 700. FIG. 15 further shows, in stippled lines, elbow pad at its most extracted position relative to upper arm protector 717. The relatively large connection surface defined by the hooks and loops fasteners situated on strap 725 yield a certain leeway that permits such a displacement. Thus, the positioning of the upper arm protectors 717, 717*a* relative to that of the shoulder pads 702 can be adjusted as can the positioning of the elbow pads 704, 704*a* relative to that of the upper arm protectors 717, 717*a*. Protective upper body assembly 700 can therefore be adjusted to conform to different player anatomies and varying equipment preferences.

The above description of preferred embodiments should not be interpreted in a limiting manner since other variations, modifications and refinements are possible within the spirit and scope of the present invention. The scope of the invention is defined by the appended claims and their equivalents.

What is claimed is:

1. A protective upper body assembly for forward and defense positions in hockey and similar sporting activities, said protective upper body assembly comprising:

i) shoulder pads including:

(a) a frontal padding element;

(b) shoulder arches;

(c) a dorsal padding element, said dorsal padding element linked by said shoulder arches to said frontal padding element; and (d) two rigid shells overlying the extremities of the shoulders, said rigid shells connected to said shoulder arches;

ii) arm protectors adapted for attachment to said shoulder pad, each said arm protector comprising:

(a) an upper arm protector for protecting the upper arm of a wearer, said upper arm protector at least partially covering the biceps of the wearer;

(b) a lower arm protector for protecting the lower arm of the wearer, said lower arm protector at least partially surrounding the lower arm of the wearer; and (c) an elbow shell between said upper arm protector and said lower arm protector for protecting the elbow of the wearer, said elbow shell at least partially surrounding the elbow of the wearer; and iii) suspending means for retaining said arm protectors to said shoulder pads.

2. A protective upper body assembly as defined in claim 1, wherein said suspending means are adapted to vary the distance between said arm protectors and said shoulder pads.

3. A protective upper body assembly as defined in claim 2, wherein said suspending means comprise straps and rings.

4. A protective upper body assembly as defined in claim 3, wherein said straps comprise hooks and loops fasteners.

5. A protective upper body assembly as defined in claim 4, wherein said strap is integrally connected to said arm protector and said ring is integrally connected to said shoulder pads.

6. A protective upper body assembly as defined in claim 1, wherein said frontal padding element comprises:

(a) a pair of chest padding elements;

(b) a sternum padding element, said sternum padding element positioned in middle of said chest padding element;

(c) a pair of side padding elements; and (d) an abdominal padding element, said abdominal padding element positioned below said pair of chest padding elements and said sternum padding element and adjacent to said pair of side padding elements.

7. A protective upper body assembly as defined in claim 6, wherein said frontal padding element is made of foam material covered by layers of woven synthetic yarn.

8. A protective upper body assembly as defined in claim 7, wherein said upper arm protector covers the entire biceps of the wearer.

9. A protective upper body assembly as defined in claim 8, wherein said arm protectors comprise means for adjusting the fit of said arm protectors.

10. A protective upper body assembly as defined in claim 9, wherein said means for adjusting the fit of said arm protectors are pull tabs.

11. A protective upper body assembly for forward and defense positions in hockey and similar sporting activities, said protective upper body assembly comprising:

i) shoulder pads including:

(a) a frontal padding element;

(b) shoulder arches; and (c) a dorsal padding element, said dorsal padding element linked by said shoulder arches to said frontal padding element;

ii) arm protectors adapted for attachment to said shoulder pad, each said arm protector comprising:

(a) an upper arm protector for protecting the upper arm of a wearer, said upper arm protector at least partially covering the biceps of the wearer;

(b) a lower arm protector for protecting the lower arm of the wearer, said lower arm protector at least partially surrounding the lower arm of the wearer; and (c) an elbow shell between said upper arm protector and said lower arm protector for protecting the elbow of the wearer, said elbow shell at least partially surrounding the elbow of the wearer; and iii) suspending means for retaining said arm protectors to said shoulder pads.

12. A protective upper body assembly as defined in claim 11, wherein said suspending means are adapted to vary the distance between said arm protectors and said shoulder pads.

13. A protective upper body assembly as defined in claim 12, wherein said suspending means comprise straps and rings.

14. A protective upper body assembly as defined in claim 13, wherein said straps comprise hooks and loops fasteners.

15. A protective upper body assembly as defined in claim 13, wherein said strap is integrally connected to said arm protector and said ring is integrally connected to said shoulder pads.

16. A protective upper body assembly as defined in claim 11, wherein said frontal padding element comprises:

(a) a pair of chest padding elements;

(b) a sternum padding element, said sternum padding element positioned in middle of said chest padding element;

(c) a pair of side padding elements; and (d) an abdominal padding element, said abdominal padding element positioned below said pair of chest padding elements and said sternum padding element and adjacent to said pair of side padding elements.

17. A protective upper body assembly for forward and defense positions in hockey and similar sporting activities, said protective upper body assembly comprising:

(a) shoulder pads for protecting the thoracic region of a wearer;

(b) upper arm protectors for protecting the upper arm of the wearer and adapted for attachment to said shoulder pads;

(c) a first set of fasteners for adjustably connecting said upper arm protectors to said shoulder pads;

(d) elbow pads at least partially surrounding the elbow of the wearer and being adapted for attachment to said upper arm protectors; and (e) a second set of fasteners for adjustably connecting said elbow pads to said upper arm protectors.

18. A protective upper body assembly as defined in claim 17, wherein said first set of fasteners includes a first strap comprising hooks and loops fasteners.

19. A protective upper body assembly as defined in claim 18, wherein said first strap is integrally connected to said upper arm protector, said first strap being adapted for insertion into a ring that is fixedly attached to said shoulder pads.

20. A protective upper body assembly as defined in claim 18, wherein said second set of fasteners includes a second strap comprising hooks and loops fasteners.

21. A protective upper body assembly as defined in claim 20, wherein said second strap is integrally connected to said upper arm fastener, said second strap being adapted for insertion into a ring that is fixedly connected to said elbow pad.

22. A protective upper body assembly as defined in claim 1, wherein said elbow shell integrally bridges said lower arm protector and said upper arm protector.

23. A protective upper body assembly as defined in claim 11, wherein said elbow shell integrally bridges said lower arm protector and said upper arm protector.

* * * * *